US007466948B2

(12) United States Patent
Brecht et al.

(10) Patent No.: US 7,466,948 B2
(45) Date of Patent: Dec. 16, 2008

(54) TRANSFER STATION FOR AN ELECTROGRAPHIC PRINTER OR COPIER

(75) Inventors: Stefan Brecht, München (DE); Friedrich Meschenmoser, Grasbrunn (DE); Christian Kürmeier, Erding (DE); Stephan Kühne, Holzkirchen (DE)

(73) Assignee: Oce Printing Systems GmbH, Poing (DE)

( * ) Notice: Subject to any disclaimer, the term of this patent is extended or adjusted under 35 U.S.C. 154(b) by 121 days.

(21) Appl. No.: 10/555,022

(22) PCT Filed: May 17, 2004

(86) PCT No.: PCT/EP2004/005310

§ 371 (c)(1),
(2), (4) Date: Sep. 21, 2006

(87) PCT Pub. No.: WO2004/102284

PCT Pub. Date: Nov. 25, 2004

(65) Prior Publication Data

US 2007/0081836 A1 Apr. 12, 2007

(30) Foreign Application Priority Data

May 19, 2003 (DE) ..... 103 22 502

(51) Int. Cl.
*G03G 15/16* (2006.01)

(52) U.S. Cl. ..... 399/313

(58) Field of Classification Search ..... 399/66, 399/310–317
See application file for complete search history.

(56) References Cited

U.S. PATENT DOCUMENTS

| | | | | |
|---|---|---|---|---|
| 4,260,236 | A | 4/1981 | Tsuda et al. | |
| 4,699,496 | A | 10/1987 | John et al. | |
| 5,051,783 | A | 9/1991 | Sato | |
| 6,072,977 | A | 6/2000 | Murakami | |
| 6,314,265 | B1 | 11/2001 | Kuermeier et al. | |
| 6,731,891 | B1 * | 5/2004 | Calamita et al. | 399/66 |
| 2004/0091293 | A1 | 5/2004 | Frodl et al. | |
| 2005/0111861 | A1 * | 5/2005 | Calamita et al. | 399/66 |
| 2005/0158076 | A1 | 7/2005 | Pichlmeier et al. | |

FOREIGN PATENT DOCUMENTS

| | | |
|---|---|---|
| DE | 197 49 386 | 2/2000 |
| DE | 101 47 684 | 4/2003 |
| EP | 0 592 197 | 4/1994 |
| WO | WO 02/077719 | 10/2002 |

* cited by examiner

*Primary Examiner*—Ryan Gleitz
(74) *Attorney, Agent, or Firm*—Schiff Hardin LLP

(57) ABSTRACT

A transfer printing station is provided with a transfer roller for transfer of a toner image generated on an intermediate carrier onto at least one recording medium in a transfer printing region of the transfer printing station. A drive unit causes the transfer roller to move towards the intermediate carrier as an ON position or away from the intermediate carrier as an OFF position, the drive unit being designed such that it is position-controlled when moving towards the ON position, and is torque controlled in the ON position.

24 Claims, 5 Drawing Sheets

TRANSFER STATION FOR AN ELECTROGRAPHIC PRINTER OR COPIER

BACKGROUND

Electrographic printer or copier devices are, for example, known from U.S. Pat. No. 6,072,977. For example, they comprise a photoconductor drum as an intermediate carrier on which is generated, by means of a laser or LED comb, a charge image of the image to be printed on a recording medium (for example a paper web). The intermediate carrier is subsequently directed to a developer station via which the charge image on the intermediate carrier is inked with toner. In a transfer printing station, the toner image is transferred from the intermediate carrier onto the recording medium and subsequently fixed in a fixing station. The printing or copying event for an image is then ended. The intermediate carrier is discharged and is then available for a new printing or copying event.

The toner image should optimally be transfer-printed from the intermediate carrier onto the recording medium without error. In the transfer printing methods used today in continuous printers in the speed range of up to approximately 1.5 m/s, print image errors primarily exist in the occurrence of voids (data loss) or brightenings in scan patterns, in blurry scan patterns and transverse stripes in scan patterns on the recording medium. In printing devices with a plurality of printing apparatuses, the 2nd printer of a twin system (or the 3rd printer of a triple system etc.) is particularly critical. This printer must print on a paper stressed (rippled, shrunk, exhibiting moisture loss) by the fixing station of the preceding printer.

Prior art in continuous printers is transfer printed with a transfer corotron; this is known, for example, from DE 197 49 386 C2. Here the recording medium is directed without additional contact pressure to the intermediate carrier in the transfer printing region and the print image is transfer-printed from the intermediate carrier onto the recording medium with the aid of the transfer corotron. The force generated on the intermediate carrier by the electrical field between transfer corotron and toner is often not sufficient in order to completely transfer the toner onto the recording medium given a rippled recording medium. Print image errors such as voids and scan blurs thereby result. Furthermore, due to the low electrostatic adhesion on the intermediate carrier, the recording medium can abruptly, uncontrollably slide through. This is shown by transverse stripes in the scanning pattern.

In order to mechanically bring the recording medium to the intermediate carrier and thereby to reduce the problems described above, additional transfer printing aids (transfer blades, pressure rollers, transfer printing jaws etc.) have been combined with a transfer corotron. However, the problems described above could not thus be completely remedied since the mechanical pressure of the recording medium on the intermediate carrier together with a transfer corotron cannot occur in the actual transfer printing region.

Furthermore, it is known (WO 02/077719 A1) to use a transfer roller as a transfer printer that presses the recording medium on the intermediate carrier in the transfer printing region. Design and function of such a transfer printing station can be learned from WO 02/077719 A1, to which reference is made and which is herewith incorporated into the disclosure. There the transfer printing station is designed such that this principle can also be used in high-speed printing or high-speed copying devices. For this, it had to be achieved that the recording medium in the transfer printing region lies securely on the intermediate carrier, so that no jumps in the relative speed between recording medium and intermediate carrier result in the printing operation and no print image errors occur on the recording medium.

Under various environmental conditions, the following disturbance variables can occur in a transfer printing station with transfer roller: partial tolerances, concentricity deviations (photoconductor, transfer roller), temperature fluctuations, contamination, wear (photoconductor, transfer roller), variable web tension in the recording medium, web tension asymmetrical with the transfer roller, varying thickness, stiffness, ripple of the recording medium. For example, it must thereby be taken into account that transfer roller and intermediate carrier must be exchanged and a perfect transfer printing must subsequently be given.

SUMMARY

An object is to specify a transfer printing station with a transfer roller that has improved functioning under variable environmental conditions.

A transfer printing station is provided comprising a transfer roller for transfer of a toner image generated on an intermediate carrier onto at least one recording medium in a transfer printing region of the transfer printing station. A drive unit causes the transfer roller to move towards the intermediate carrier as an ON position or away from the intermediate carrier as an OFF position, the drive unit being designed such that it is positioned-controlled when moving towards the ON position, and is torque controlled in the ON position.

DESCRIPTION OF THE PREFERRED EMBODIMENT

Figure 1:
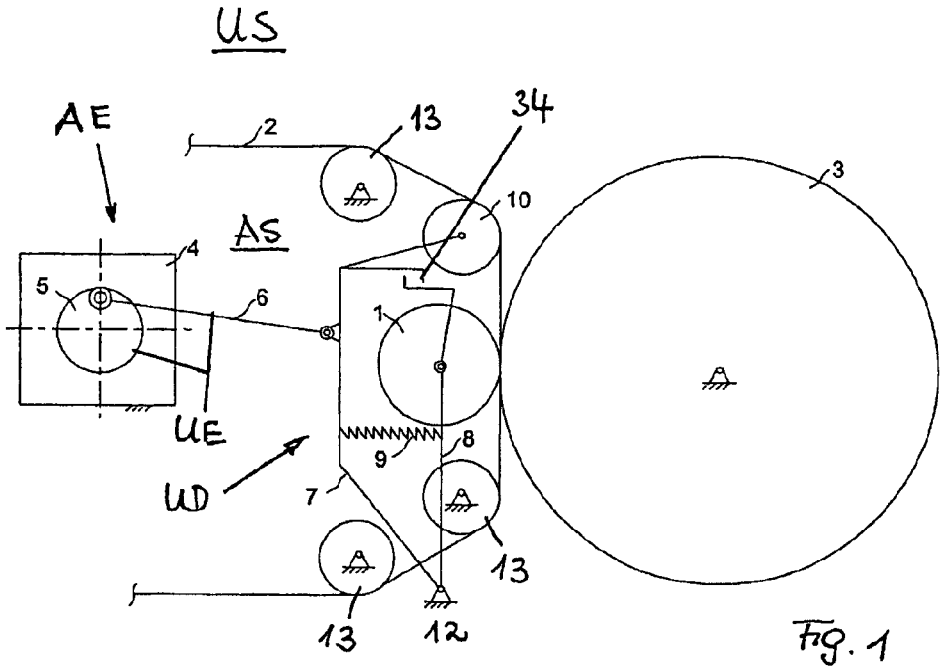
FIG. 1 is a side view of the drive system for the case that the transfer printing unit is pivoted towards (ON position)

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Relative to conventional systems, the following advantages result with the preferred embodiment:

The recording medium is uniformly pressed onto the intermediate carrier over the entire width with a transfer roller borne in such a manner. The toner image is thus properly transferred onto the recording medium.

Electrical field lines and pressing force on the recording medium act at the same location—in the transfer printing region—and in the same direction.

Jumps in the relative speed between recording medium and intermediate carrier and the print image errors specified above are effectively prevented via the suitably-selected pressing force of the transfer roller.

The transfer roller can be moved exactly via the drive unit. Relative speeds between recording medium and intermediate carrier are thereby prevented given pivoting to and from.

A constant pressing force of the transfer roller on the intermediate carrier is ensured. The pressing force can be adjusted depending on a property of the recording medium.

The properties of the drive system adapt to the conditions in the printing device. An equally good result (equal pressing force, compensation of various positions of the transfer printing line) is always achieved over the lifespan (wear, also electrical wear of the transfer roller). The advantage is that a higher speed of the recording medium can be realized.

Developments of the Invention Result from the Dependent Claims.

To prevent printing errors caused by (asymmetrical) imbalance or (asymmetrical) radial deviation of the intermediate carrier, the transfer roller, or of the recording medium, or by non-parallelism of transfer roller and intermediate carrier in the radial direction, at least one compensation device can be provided in the transfer printing unit. This compensation device can be non-uniformly active over the width of the transfer roller and thereby compensate tolerances in the transfer roller or intermediate carrier. Depending on the usage case, two or more compensation devices can thus also be used.

The drive unit thus uniformly compensates imbalance, radial deviation or thickness changes in the recording medium over the width of the intermediate carrier.

A motor that can operate in a position-controlled mode and in a torque controlled mode can be used as a drive unit. The motor can be a rotatory motor, (for example a brushless direct current motor) or a linear motor.

It is advantageous when the transfer printing unit comprises a pressure bar borne on one side, on which pressure bar the transfer element engages, and at least one (advantageously at least two) bearing rockers borne on the pressure bar, in which bearing rocker the transfer roller is borne. The bearing rockers and the pressure bar can be borne such that they can rotate on a common rotation bearing. The bearing rockers can additional move around the rotation axis relative to the pressure bar, such that the transfer roller can be placed parallel to the intermediate carrier. Given movement of a bearing rocker counter to the pressure bar, at least one compensation device can be stressed or de-stressed. The transfer printing unit (and with it the transfer roller) can then be pivoted onto or away from the intermediate carrier by the transfer element. The pivot event can be achieved in that the transfer element is connected via a coupling arm with an eccentric that is arranged at the drive shaft of the drive unit. However, it is also possible to use a linearly-operating drive unit (linear motor) instead of the rotatory drive unit (motor with transfer element).

In order to be able to correct the radial deviation of the intermediate carrier or of the transfer roller with the aid of the transfer roller, this is thus borne such that the at least one compensation device exerts a pressure in the direction towards the intermediate carrier. The compensation device can, for example, be comprised of elastic elements. The drive unit then uniformly compensates the radial deviation over the width of the transfer roller (transfer roller remains parallel to the rotation axis). When two compensation devices are provided, respectively one per bearing rocker, these act non-uniformly over the width of the transfer roller, namely at the front and rear given different radial deviation, so that a wobble deviation as well as a skew state of the transfer roller relative to the intermediate carrier is provided.

The pressure bar can be provided with a deflection roller for the recording medium. In the ON-position, this deflection roller can produce a tangential web run relative to the intermediate carrier. When the deflection roller is arranged on the pressure bar, the compensation device does not act on the deflection roller. Recording medium webs that do not run symmetrically with the transfer roller can thus also be processed since the deflection roller cannot lift on one side given a one-sided web tension, meaning that the axis of the deflection roller remains parallel to the axis of the intermediate carrier. Given one-sided web tension, the transfer roller does not lift since the belt wrap angle of the recording medium on the transfer roller is nearly zero, and thus barely any forces from the web tension react on the compensation devices.

Via a corresponding arrangement of the deflection roller, it is possible to direct the recording medium tangential to the surface of the transfer roller and a drum-shaped intermediate carrier. Such a direction can also be achieved when rollers or jaws are arranged in a corresponding manner in the deflection unit. The advantage of such a guidance of the recording medium lies in that the toner evaporation is minimized and the print image is more uniform.

The transfer printing station of the preferred embodiment is particularly suitable for printing devices that print a belt-shaped recording medium with high speed and in which the intermediate carrier is a photoconductor drum.

The angle at which the drive shaft is to be moved from the OFF position to the ON position can be established with the aid of a position counter, whereby a first or second counter state is associated with the OFF position or the ON position. The second counter state thereby acts as a desired quantity or control specification for the torque regulation. The torque can be adapted given excess of a defined position deviation.

When a transfer printing station is integrated into a printing device, it is advantageous when the OFF position and the ON position are calibrated. It is thereby ensured that the transfer roller always lies on the intermediate carrier with the necessary pressure. The OFF position can be located such that the drive shaft is rotated until, for example, a Hall switch arranged at the OFF position acts, or the eccentric rests at a mechanical stop. The first counter state of the position counter thereby achieved can then be stored or the position counter is reset to a predetermined initial value. The OFF position then results via a defined difference from the first counter state. Controlled by the torque, the drive shaft can subsequently move the transfer printing unit to the intermediate carrier until the drive shaft is blocked after impinging the transfer roller on the intermediate carrier. Disturbance variables such as, for example, web tension in the recording medium are thereby compensated or can be determined. The second counter state of the position counter then achieved can be stored in turn. In order to compensate tolerances, this pivot event can, for example, be repeated with different intermediate carrier positions; this can also occur given continuous rotation of the intermediate carrier. The intermediate carrier must thereby not be removed. An average value that is used in the printing operation as a second counter state can subsequently be formed from the determined second counter states. A corresponding measurement event can naturally also be conducted in printing pauses in order to, for example, compensate for wear in the transfer roller or the intermediate carrier.

In the printing operation, the transfer printing unit initially stands in the OFF position. For printing, the transfer printing unit is pivoted towards the intermediate carrier until the second counter state is achieved. The pivoting event thus occurs controlled by position. When the second counter state is achieved, the drive unit switches over to torque control, such that the transfer roller rests on the intermediate carrier with an adjustable (via the rotation moment) pressing force. Given excess of a defined position/ deviation, the rotation moment in the printing operation can be adapted (superimposed position regulation). In the printing pause, the transfer printing unit is again pivoted (controlled by position) away from the intermediate carrier until the first counter state is achieved. Naturally, the end positions of the transfer printing unit can also be established with other means; for example, a Hall switch whose sensor signal is evaluated could respectively be arranged in the end positions.

From the following drawing Figures of the electrophotographic printer or copier device, only the transfer printing station is shown, which transfer printing station is shown in principle. The remaining components of the printer or copier device can be designed in a known manner.

Figure 2:
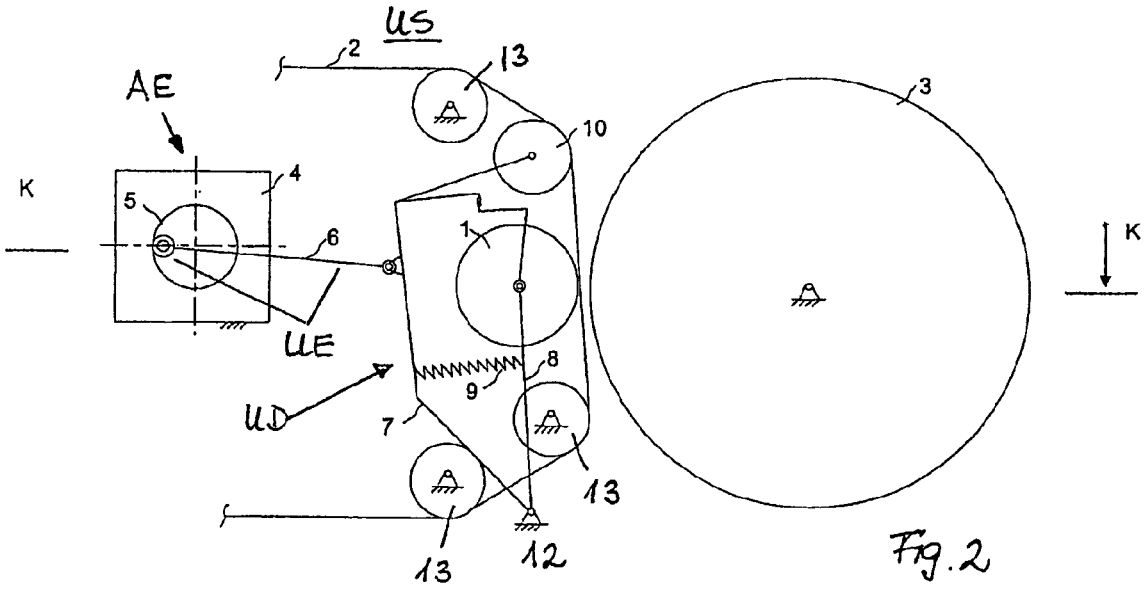
FIG. 2 is a side view of the drive system for the case that the transfer printing unit is pivoted away (OFF position)

The design of the transfer printing station US arises from FIGS. 1 and 2, whereby FIG. 1 shows the transfer printing station in the pivoted-towards position (ON position), and FIG. 2 shows the transfer printing station in the pivoted-away position (OFF position).

The transfer printing station US serves in a known manner to transfer-print toner images from an intermediate carrier 3 (for example a photoconductor drum) onto a recording medium 2 (for example a paper web). The transfer printing occurs with the aid of a transfer roller 1 whose function is, for example, described in WO 02/077 19.

The transfer printing station US comprises a drive system AS that comprises the following components:

- a drive unit AE, for example a motor with controller, whereby the drive unit AE can be operated both in a position-controlled mode and in a torque-controlled mode;
- a mechanical transfer element UE;
- a transfer printing unit UD.
- additionally at least one compensation device 9 can be provided, advantageously two compensation devices 9*a*, 9*b*.

The drive unit AE can be comprised of a motor 4 with motor controller (FIG. 5) on whose drive shaft 11 the transfer element UE engages. This comprises an eccentric 5 and a coupling arm 6. The eccentric 5 is arranged on the drive shaft 11 (FIG. 3), the coupling arm 6 can rotate and is eccentrically borne on the eccentric 5 and is borne such that it can rotate on the transfer printing unit UD. Given movement of the drive shaft 11, the coupling arm 6 directs a movement out towards the intermediate carrier 3.

The transfer printing unit UD comprises the following components:

- a pressure bar 7 on which the coupling arm 6 is borne and that, for example, is respectively arranged on one end in a rotation bearing 12*a*, 12*b* on both sides;
- in the exemplary embodiment, two bearing rockers 8*a*, 8*b* in which the transfer roller 1 is borne; the bearing rockers 8*a*, 8*b* are likewise arranged such that they can rotate around the rotation bearings 12*a*, 12*b*;
- possibly a deflection roller 10 for the recording medium 2 on the pressure variable 7.

Figure 3:
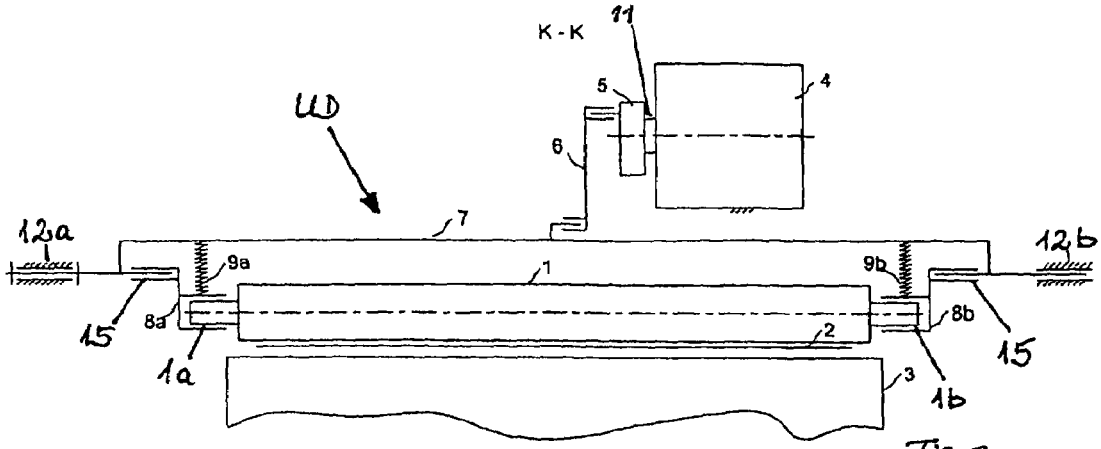
FIG. 3 is a section view at the suction line K-K of FIG. 2.

The possibly-provided compensation devices 9*a*, 9*b* act between pressure bar 7 and bearing rockers 8*a*, 8*b* such that a pressure on the bearing rockers 8*a*, 8*b* and therewith on the transfer roller 1 is exerted in the direction towards the intermediate carrier 3. It is therewith advantageous when the bearing rockers 8*a*, 8*b* can move relative to the pressure bar 7. The compensation devices 9*a*, 9*b* can, for example, comprise an elastic or possibly a damping element as shown in FIG. 1 through 3. The transfer roller 1 can thereby rest parallel on the intermediate carrier 3. The bearing rockers 8*a*, 8*b* thereby possibly move relative to the pressure bar 7, whereby the compensation devices 9*a*, 9*b* are somewhat more stressed or de-stressed. Furthermore, it is advantageous when at least two compensation devices 9*a*, 9*b* are provided within the transfer printing unit UD in order to achieve a uniform pressure on the intermediate carrier 3 over the entire width of the transfer roller 1.

Furthermore, further additional guide rollers 13 for the recording medium 2 can be provided.

FIG. 1 shows the state in which the transfer printing unit UD and therewith the transfer roller 1 is pivoted onto the intermediate carrier 3 (=ON position). The eccentric 5 thereby stands in a position that is advantageous for the torque regulation, removed by approximately 90° from the rear slack point HT (linear transfer behavior). In order to pivot the transfer printing unit UD away from the intermediate carrier 3, the drive shaft 11 is rotated corresponding to FIG. 2, the eccentric 5 drawings the transfer printing unit UD over the coupling arm 6 and thus drawings the transfer roller 1 away from the intermediate carrier 3 into the OFF position. The transfer printing unit UD thereby rotates around the rotation bearings 12*a*, 12*b*.

As long as no pressure dominates between transfer roller 1 and intermediate carrier 3, the compensation devices 9*a*, 9*b* each press the bearing rockers 8*a*, 8*b* against a stop 34 on the pressure arm 7; in these phases the bearing rockers 8*a*, 8*b* and the pressure bar 7 move synchronously.

The view along section line K-K of FIG. 2 is shown in FIG. 3. The drive unit AE comprises a drive shaft 11 on which the eccentric 5 is borne The coupling arm 6 is borne both on the eccentric 5 and on the pressure bar 7 such that it can rotate. The bearing pins 1*a*, 1*b* of the transfer roller 1 are borne in the bearing rockers 8*a*, 8*b*. The bearing 1*a*, 1*b* (for example a ball bearing) of the transfer roller 1 in the bearing rockers 8*a*, 8*b* can accommodate a skew position of the axis from the transfer roller 1 to the rotation bearing 12. The bearing rockers 8*a*, 8*b* are furthermore borne such that they can move around the axes 12*a*, 12*b* relative to the pressure bar 7. The transfer roller 1 can thus be adjusted in the direction towards the intermediate carrier 3 via the compensation devices 9*a*, 9*b*, such that the pressing force is equally distributed over the width of the recording medium 3 even given wobble skew. The compensation devices 9 can have damping properties; moreover, the available compensation path is selected so small that the drive system AS exhibits no oscillation tendency.

Figure 4:
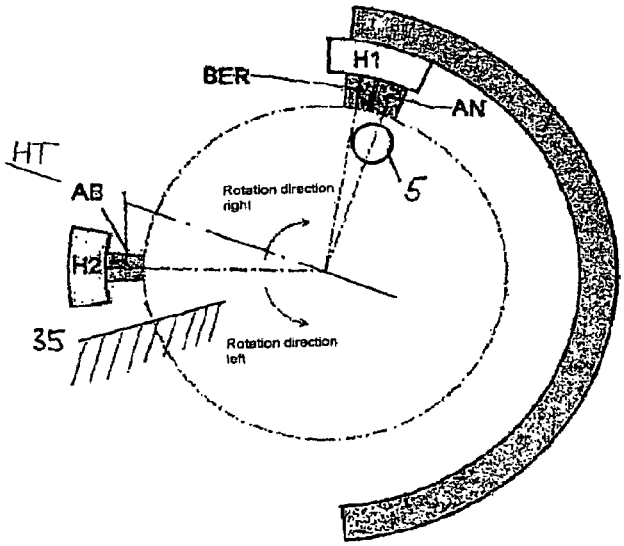
FIG. 4 is a principle representation of the pivot range of the drive system.

A principle representation of the rotation movement of the drive shaft from the ON position to the OFF position and the reverse results from FIG. 4. In order to be able to establish these end positions, for example, Hall switches H can be arranged on these. The Hall switches H emit a sensor signal when, for example, a marking on the drive shaft passes by the corresponding Hall switch. For example, starting from the OFF position (Hall switch H2), a rotation of the drive shaft to the right occurs until the ON position (at which a Hall switch H1 can be arranged) is achieved. Before the ON position is achieved, the transfer roller 1 has already contacted the intermediate carrier 3 at the point BER. In FIG. 4, the individual positions of the drive shaft are shown with a tolerance range. The OFF position can, however, also be established with a mechanical reference stop 35. In the ON position, the eccentric 5 can lie approximately 90° removed from a slack point HT in order to make a torque control easier.

When, for example, a transfer printing station US or a new transfer roller 1 is inserted into a printing device, it is advantageous to adjust the drive unit AE in terms of its rotation movement such that the transfer printing unit UD and therewith the transfer roller 1 can be pivoted exactly from the OFF position to the ON position and tolerances (for example in the intermediate carrier 3, the transfer roller 1 or the recording medium 2) are compensated. For this, both the OFF position, but in particular the ON position, must be precisely determined. For example, this can occur with the aid of a position counter whose counter state indicates the position of the drive shaft 11.

The OFF position is then initially established. For this, for example, a Hall switch H2 can be used that emits a sensor signal when a marking of the drive shaft 11 passes by the Hall switch H2. However, it is also possible to arrange a mechanical stop 35 at this point that limits the rotation movement of the drive shaft 11. The counter state of the position counter in this position is stored as a first counter state. As FIG. 4 shows, the OFF position can thereby lie at a defined distance from the reference stop 35. The drive unit AE is henceforth switched into the torque-controlled mode and the drive shaft 11 moves until it is blocked. This is the case when the transfer roller 1 rests on the intermediate carrier 3 with a corresponding pressing force. This pressing force can thus be influenced via the torque. In this position, the counter state of the position counter is stored as a second counter state. This second counter state event can be repeated multiple times, for example in order to compensate tolerances of the intermediate carrier 3 or of the transfer roller 1. An average value that is used in the printing operation can then be formed from the various second counter states.

In the printing operation, the drive unit AE is initially operated in the position-controlled mode, starting from the OFF position. The drive shaft 11 moves the transfer printing unit UD and the transfer roller 1 towards the intermediate carrier 3. When the position counter has reached its second counter state, the transfer roller 1 is in an operation position for the transfer printing. At that time the drive unit AE is switched into the torque-controlled mode, whereby the transfer roller 1 rests on the intermediate carrier 3 with the desired pressing force.

After the end of the transfer printing event, the transfer printing unit UD and the transfer roller 1 is pivoted away from the intermediate carrier 3. For this, the drive unit AE is switched into the position-controlled mode and the drive shaft 11 is moved until the first counter state is reached.

Figure 5:
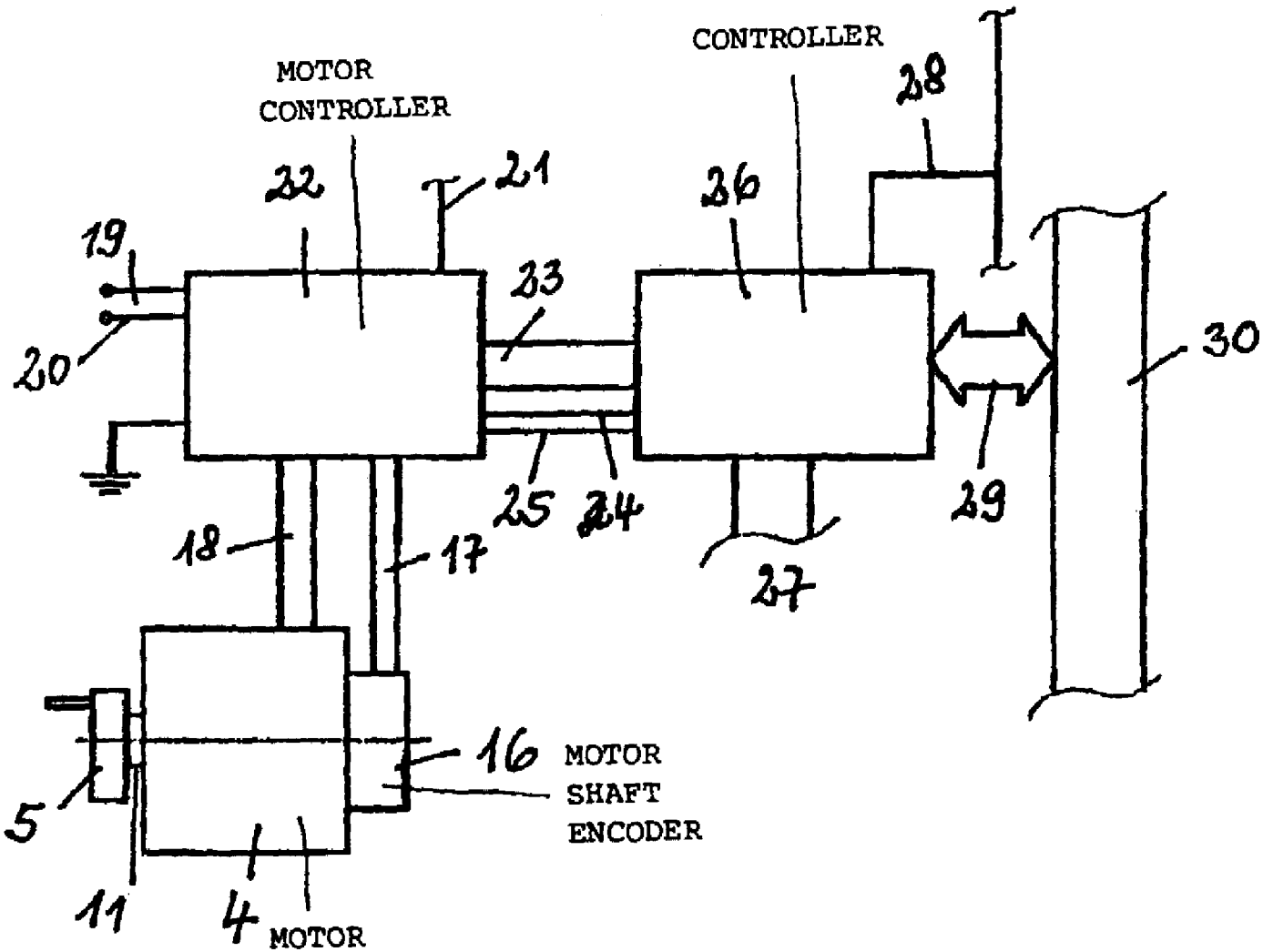
FIG. 5 shows a control circuit for the drive system.

A design of the drive unit AE results from FIG. 5. It comprises a motor 4, a motor controller 22 and a controller 26 for the recording medium 2. An incremental motor shaft encoder 16 is arranged at the motor in order to enable a step-by-step position monitoring with high resolution, for example 360°/8196 incremental signals. Conductors 17 lead from this to the motor controller 22, over which conductors the incremental signals are transferred to the position counter realized on the motor controller 22. Conductors 18 furthermore lead to the power supply for the motor 4. Additionally, via a conductor 21 the motor controller 22 can be supplied a signal for pivoting towards or pivoting away, for example for safety reasons.

The motor controller 22 is furthermore connected with the recording medium 26 over conductors 23, 24 and 25. The conductor 23 is a BUS conductor for transfer of parameters (for example rotation moment, operating mode, error notification. Start-stop signals for the transfer printing station (for example triggers of actions such as pivoting towards or pivoting away) can be transferred over the conductor 24. Reset signals in order to reset the motor controller into an initial state can be transferred via the conductor 25. Sensor signals (for example of force sensors, web tension sensors) are supplied to the controller 26 via the conductors 27. Trigger signals are supplied over the conductor 28. Device data from the device bus 30 are supplied over the bus 29. Position-guided motors (for example step motors) can be used for the actuation via force sensors for the compensation devices 9.

The preferred embodiment has been described in connection with a rotatory drive. However, it is also possible to use a linear motor as a drive, which linear motor must, however, likewise be operated in the two operating modes illustrated above. Finally, it is also possible to use two or more drive units that can then be arranged at various points of the transfer printing unit UD. If the transfer roller 1 can additionally exhibit elastic or damping properties achieved, for example, via a rubber coating, the compensation device 9 can then possibly be omitted.

The function of the transfer roller 1 is further improved when the recording medium 2 is directed tangential to the surfaces of the transfer roller 1 and the intermediate carrier 3. It is thereby ensured that the toner transfer direction lies perpendicular to the plane of the recording medium 2 and corresponds to the electrical field between intermediate carrier 3 and transfer roller 1. The result is that the toner evaporation is minimized and the print image is more uniform.

Figure 6:
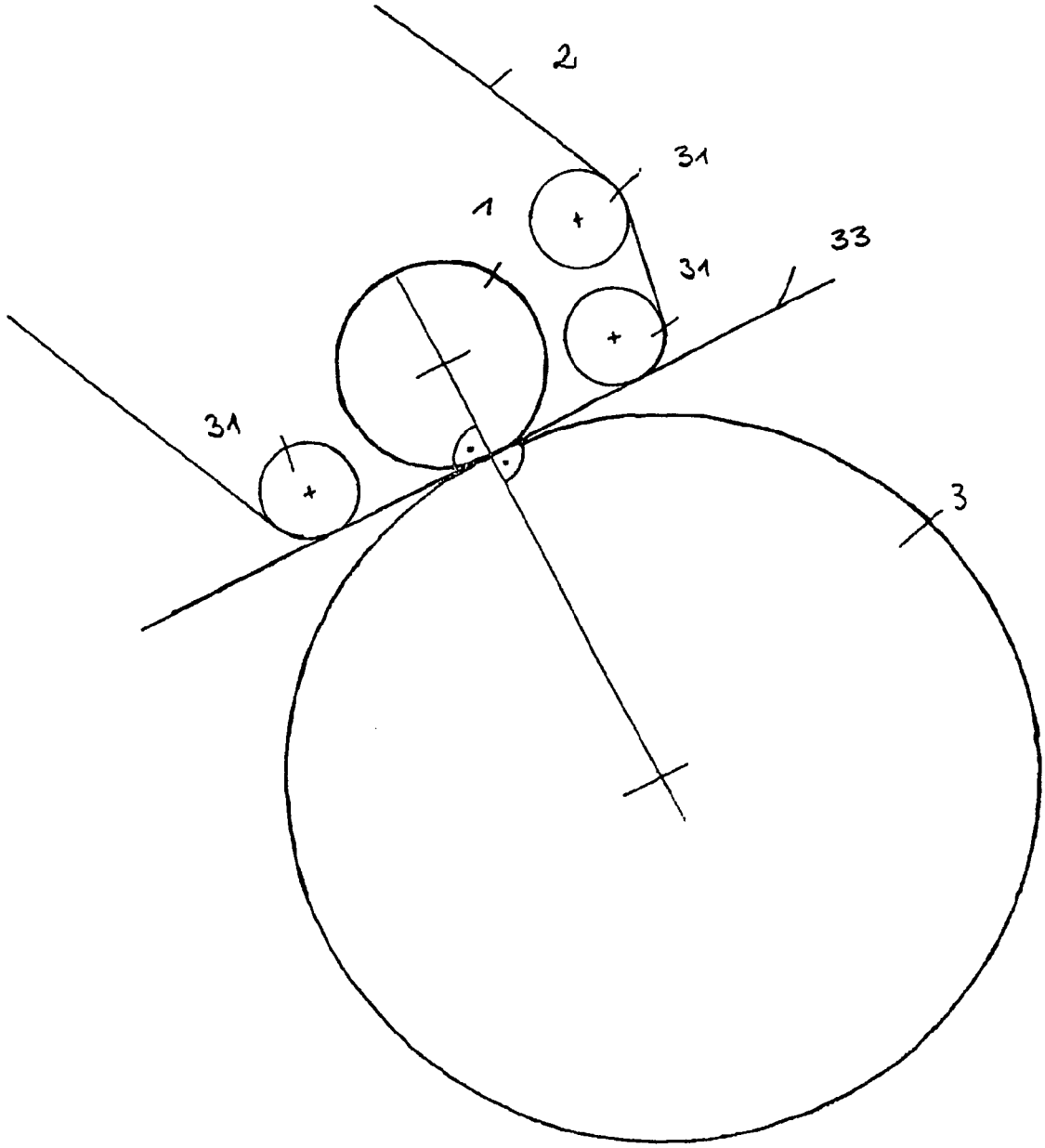
FIG. 6 illustrates an example of a tangential guidance the recording medium over transfer roller and intermediate carrier with deflection rollers.
Figure 7:
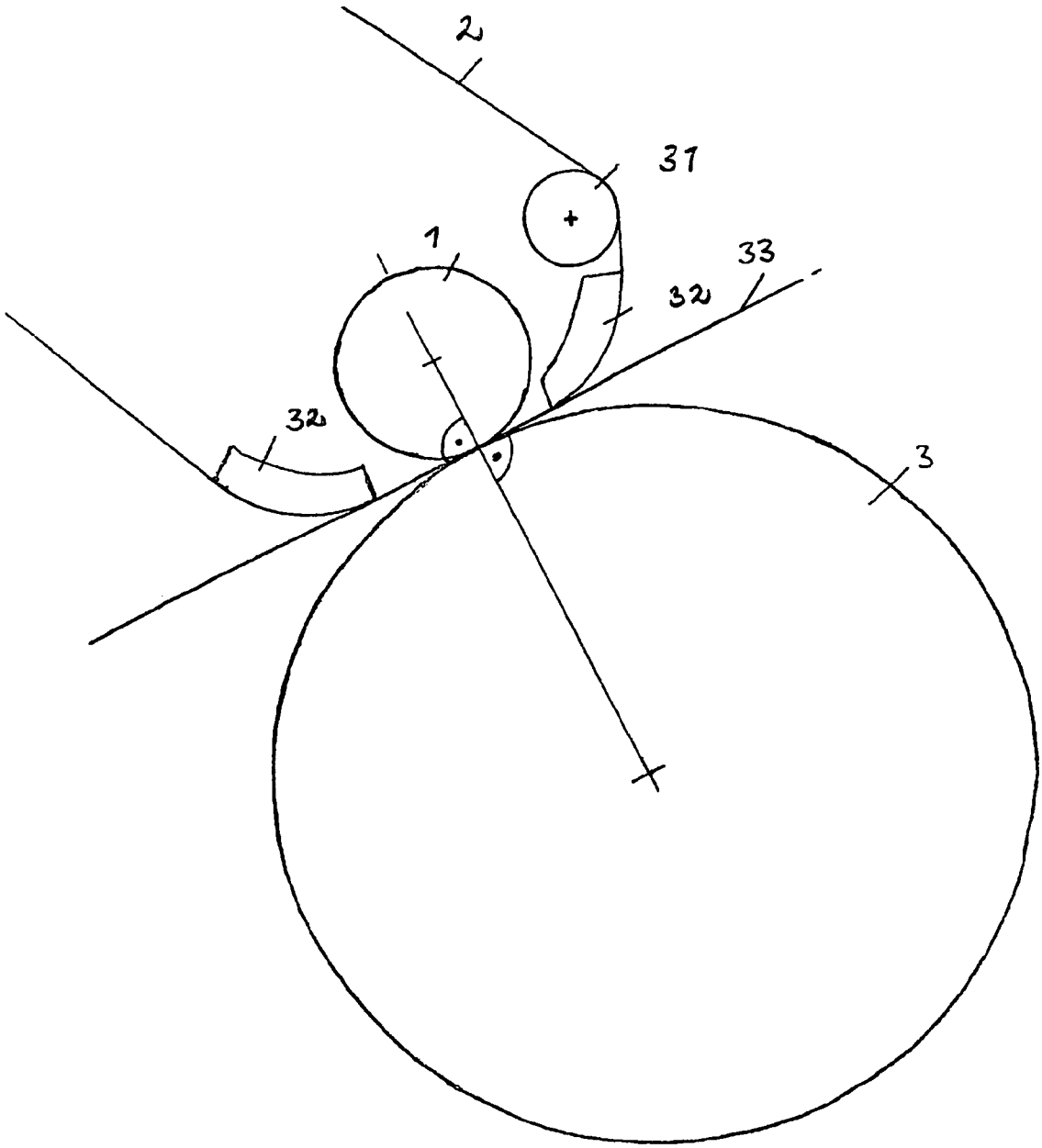
FIG. 7 is an example of a tangential guidance of the recording medium over transfer roller and intermediate carrier with deflection jaws.

Two realizations of such a guidance of the recording medium result from FIG. 6 and FIG. 7. In FIG. 6, the corresponding guidance of the recording medium 2 is achieved with the aid of deflection rollers 31, in FIG. 7 with the aid of deflection jaws 32. The tangential 33 is likewise drawn. In FIGS. 6 and 7, the elements of the transfer printing station US according to FIG. 1 through 3 that are not necessary for the representation of the principle have been omitted.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A transfer printing station for an electrographic printer or copier device comprising:

a transfer roller for transfer of a toner image generated on an intermediate carrier onto at least one recording medium in a transfer printing region of the transfer printing station;

at least one drive system having a drive unit;

a transfer printing unit in which the transfer roller is provided;

the drive unit pivoting, via a transfer element, the transfer printing unit and thus the transfer roller towards the intermediate carrier as an ON position or away from the intermediate carrier as an OFF position, said drive unit being designed such that it is position-controlled in the pivoting towards operation until reaching the ON position, and is torque controlled in the ON position; and at least one compensation device arranged between the transfer printing unit and a pressing location of the transfer roller and designed such that it uniformly presses the transfer roller onto the intermediate carrier over a width of said transfer roller.

2. A transfer printing station according to claim 1 in which the transfer printing unit comprises:

a pressure bar provided on one side on which the transfer element engages; and at least one bearing rocker provided in the pressure bar, the transfer roller being provided in said bearing rocker.

3. A transfer printing station according to claim 2 in which the transfer element comprises an eccentric arranged on a drive shaft of the drive unit and comprises a coupling arm provided on the eccentric and the transfer printing unit such that it rotates and transfers a motion of the eccentric to the transfer printing unit.

4. A transfer printing station according to claim 2 in which the transfer roller comprises bearing pins at both ends that are provided in two bearing rockers.

5. transfer printing station according to claim 4 in which two compensation devices are provided, one per bearing rocker.

6. A transfer printing station according to claim 5, in which the bearing rockers are provided in the pressure bar such that they are movable relative to the pressure bar, and such that the compensation devices act so that the transfer roller is pressed against the intermediate carrier uniformly over its width.

7. A transfer printing station according to claim 1 in which the at least one compensation device is comprised of elastic elements.

8. A transfer printing station according to claim 2 in which a deflection roller via which the recording medium is directed is arranged at the pressure bar.

9. A transfer printing station according to claim 8 in which the deflection roller is arranged on a side of the pressure bar facing away from the rotation bearing.

10. A transfer printing station for an electrographic printer or copier device comprising:

a transfer roller for transfer of a toner image generated on an intermediate carrier onto at least one recording medium in a transfer printing region of the transfer printing station;

at least one drive system having a drive unit;

a transfer printing unit in which the transfer roller is provided;

the drive unit pivoting, via a transfer element, the transfer printing unit and thus the transfer roller towards the intermediate carrier as an ON position or away from the intermediate carrier as an OFF position, said drive unit being designed such that it is position-controlled in the pivoting towards operation until reaching the ON position, and is torque controlled in the ON position; and the drive unit comprising a position counter that counts a rotation of the drive shaft step-by-step.

11. A transfer printing station for an electrographic printer or copier device comprising:

a transfer roller for transfer of a toner image generated on an intermediate carrier onto at least one recording medium in a transfer printing region of the transfer printing station;

at least one drive system having a drive unit;

a transfer printing unit in which the transfer roller is provided;

the drive unit pivoting, via a transfer element, the transfer printing unit and thus the transfer roller towards the intermediate carrier as an ON position or away from the intermediate carrier as an OFF position, said drive unit being designed such that it is position-controlled in the pivoting towards operation until reaching the ON position, and is torque controlled in the ON position; and Hall switches arranged in the drive unit, one to establish the OFF position and one to establish the ON position.

12. A transfer printing station for an electrographic printer or copier device comprising:

a transfer roller for transfer of a toner image generated on an intermediate carrier onto at least one recording medium in a transfer printing region of the transfer printing station;

at least one drive system having a drive unit;

a transfer printing unit in which the transfer roller is provided;

the drive unit pivoting, via a transfer element, the transfer printing unit and thus the transfer roller towards the intermediate carrier as an ON position or away from the intermediate carrier as an OFF position, said drive unit being designed such that it is position-controlled in the pivoting towards operation until reaching the ON position, and is torque controlled in the ON position; and a reference stop arranged in the drive unit to establish the OFF position.

13. A transfer printing station according to claim 12 in which the drive unit comprises a rotatory motor or a linear motor.

14. A transfer printing station according to claim 12 in which the transfer roller exhibits damping properties.

15. A transfer printing station for an electrographic printer or copier device comprising:

a transfer roller for transfer of a toner image generated on an intermediate carrier onto at least one recording medium in a transfer printing region of the transfer printing station;

at least one drive system having a drive unit;

a transfer printing unit in which the transfer roller is provided;

the drive unit pivoting, via a transfer element, the transfer printing unit and thus the transfer roller towards the intermediate carrier as an ON position or away from the intermediate carrier as an OFF position, said drive unit being designed such that it is position-controlled in the pivoting towards operation until reaching the ON position, and is torque controlled in the ON position; and the transfer printing unit comprising a deflection unit for the recording medium arranged such that the recording medium between the intermediate carrier and the transfer roller is directed tangential to surfaces of the intermediate carrier and the transfer roller.

16. A transfer printing station according to claim 15 in which the deflection unit comprises deflection rollers.

17. A transfer printing station according to claim 15 in which the deflection unit comprises deflection jaws.

18. A transfer printing station according to claim 15 in which the recording medium is belt-shaped.

19. A method for transfer printing of toner images applied on an intermediate carrier onto a recording medium by use of a transfer roller, comprising the steps of:

providing a drive unit which causes a transfer printing unit with the transfer roller to move towards the intermediate carrier as an ON position or away from the intermediate carrier as an OFF position;

moving the transfer roller towards said intermediate carrier by use of the drive unit which is position-controlled until reaching said ON position, and which is torque controlled in said ON position;

transferring the toner image generated on the intermediate carrier by use of the transfer roller onto the at least one recording medium in the ON position; and to determine the OFF position of the transfer printing unit, the drive unit moving the transfer printing unit until a Hall switch for the OFF position activates or until it impinges on a mechanical reference stop, in which an achieved position of the drive shaft is then stored.

20. A method for transfer printing of toner images applied on an intermediate carrier onto a recording medium by use of a transfer roller, comprising the steps of:

providing a drive unit which causes a transfer printing unit with the transfer roller to move towards the intermediate carrier as an ON position or away from the intermediate carrier as an OFF position;

moving the transfer roller towards said intermediate carrier by use of the drive unit which is positioned-controlled until reaching said ON position, and which is torque controlled in said ON position;

transferring the toner image generated on the intermediate carrier by use of the transfer roller onto the at least one recording medium in the ON position; and the ON Position of the transfer printing unit being determined such that the drive unit moves the transfer printing unit towards the intermediate carrier until the transfer roller rests on the intermediate carrier and blocks the drive shaft, and then this position of the drive shaft is stored.

21. A method according to claim 20 in which the position of the drive shaft is measured with the aid of a position counter.

22. A method according to claim 20 in which, upon pivoting the transfer printing unit from the OFF position, the drive unit is initially moved in said position-controlled manner until the ON position is reached, and then the drive unit is switched over to said torque-control in order to adjust a constant pressing force of the transfer roller on the intermediate carrier.

23. A method according to claim 20 in which the pivot-away event occurs position-controlled until the OFF position is reached.

24. A method for transfer printing of toner images applied on an intermediate carrier onto a recording medium by use of a transfer roller, comprising the steps of:

providing a drive unit which causes a transfer printing unit with the transfer roller to move towards the intermediate carrier as an ON position or away from the intermediate carrier as an OFF position;

moving the transfer roller towards said intermediate carrier by use of the drive unit which is positioned-controlled until reaching said ON position, and which is torque controlled in said ON position;

transferring the toner image generated on the intermediate carrier by use of the transfer roller onto the at least one recording medium in the ON position; and the OFF position and the ON position being determined from a counter state of a position counter.

* * * * *